United States Patent [19]

Rammos

[11] Patent Number: 4,644,362

[45] Date of Patent: Feb. 17, 1987

[54] WAVEGUIDE ANTENNA OUTPUT FOR A HIGH-FREQUENCY PLANAR ANTENNA ARRAY OF RADIATING OR RECEIVING ELEMENTS

[75] Inventor: Emmanuel Rammos, Creteil, France

[73] Assignee: U.S. Philips Corporation, New York, N.Y.

[21] Appl. No.: 639,284

[22] Filed: Aug. 9, 1984

[30] Foreign Application Priority Data

Aug. 19, 1983 [FR] France ..... 83 13478

[51] Int. Cl.[4] ..... H01Q 13/02

[52] U.S. Cl. ..... 343/778; 343/786

[58] Field of Search ..... 343/776, 769, 778, 797

[56] References Cited

U.S. PATENT DOCUMENTS 4,208,660 6/1980 McOwen ..... 343/769

*Primary Examiner*—Eli Lieberman

*Attorney, Agent, or Firm*—Robert J. Kraus

[57] ABSTRACT

Antenna output for a planar antenna comprising an array of receiving elements provided by two networks (20, 30) of high frequency transmission lines and three sheets (10, 40, 50). The first sheet (10) comprises first cavities (11), the first and second transmission line networks are planar, located respectively on either side of this first sheet and, for signal reception, coupled to each of the cavities by a corresponding number of distinct ends forming exciting probes along two perpendicular axes. The third and second sheets (40, 50) are located on the other side of both of these networks and comprise second and third cavities (41, 51) which are in line with the first cavities. The third cavities are short-circuited in a plane parallel to the surfaces of the sheets, and these sheets are made of a metal or of a dielectric material having metal-plated walls of the cavities. The antenna output is formed by ends (122, 132) of the two transmission line networks which form exciting probes coupled to a waveguide (60) which is located in and opens toward the rear of the antenna.

2 Claims, 2 Drawing Figures

WAVEGUIDE ANTENNA OUTPUT FOR A HIGH-FREQUENCY PLANAR ANTENNA ARRAY OF RADIATING OR RECEIVING ELEMENTS

BACKGROUND OF THE INVENTION

The present invention relates to a waveguide antenna output for a planar antenna comprising an array of radiating or receiving elements for high-frequency signals. It also relates to a system for transmitting or receiving high-frequency signals, comprising a planar antenna having such an antenna output, used in systems for receiving 12 GHz television signals, more specifically television signals transmitted by geostationary satellites.

The two French Patent Applications No. 81 08 780 (corresponding to U.S. Pat. No. 4,486,758) and No. 82 04 252 (corresponding to U.S. Pat. No. 4,527,165), published by Applicants on May 4, 1981 and Mar. 12, 1982, respectively both describe a high-frequency planar antenna comprising an array of radiating or receiving elements. The first of the French patent applications relates to an antenna whose elements are formed on the one hand from three insulating sheets in which miniature horns of a square or a rectangular cross-section are provided and whose inside surface is metal-plated and on the other hand from two supply networks arranged between these respective sheets for receiving signals propagating in the miniature horns. The second patent application relates to an antenna which is likewise formed from three sheets and two supply networks but in which, to put it more precisely, the elements have a first layer with a first cavity, first and second networks of high-frequency transmission lines situated on both sides of this first layer and coupled for the reception of signals to each cavity along two perpendicular axes, (but in parallel with the respective elements) and on the other side of both supply networks second and third layers having cavities corresponding to the first cavities, the three layers or sheets thus provided being made of metal or of a dielectric material with metal-plated walls of the cavities penetrating them. In both these applications the cavities in the sheet or rear layer are inter alia short-circuited, at a depth which is generally near $\lambda/4$.

The structures described in the two above-mentioned documents have however the disadvantage that the supply networks which take off the signals propagating in the cavities are not in the same plane but are remote from each other for a distance equal to the width of the first sheet and that this arrangement causes a phase shift between the signals received by either the one or the other of these networks. This width and consequently the phase shift may be reduced, but only to a very small extent, when the transmission line networks are provided with grooves for guiding the central conductors of these lines as is disclosed in the second of the above-mentioned applications.

SUMMARY OF THE INVENTION

It is therefore a first object of the invention to provide an antenna output for planar antennas having arrays of elements in which the above-mentioned disadvantage is wholly eliminated.

The invention relates to an antenna output for a planar antenna comprising an array of receiving/transmitting elements. The antenna includes two high-frequency transmission line networks and three sheets arranged such that the first sheet comprises first cavities, the first and second transmission line networks are planar, located respectively on both sides of this first sheet and, for signal reception, are coupled to each of the cavities via a corresponding number of distinct ends which form exciting probes along two perpendicular axes. The second and third sheets are situated on the other sides of these two respective networks and comprise second and third cavities which are in-line with the first cavities, these third cavitites being short-circuited in a plane parallel to the surfaces of the sheets. The sheets are metal or made of a dielectric material with metal-plated cavity walls. The antenna output being characterized in that a single end of each of the two networks of transmission lines forms an exciting probe and is coupled to a waveguide located in and opening to the rear of the antenna. The waveguide includes, in succession, a first cavity in the rear sheet, the third sheet of the antenna, a second cavity in the central sheet, the first sheet, and provided in the front sheet, the second sheet, a third cavity which is short-circuited in a plane parallel to the surfaces of the sheets at a depth equal to the depth of the short-circuiting plane of the receiving elements.

Because of the location, on the rear of the antenna, of an element which is arranged in the opposite sense relative to the receiving elements on the front face, the above-described structure ensures recovery of the correct phase, the strict synchronization of the signals flowing through all the respective transmission line networks. In this element which is arranged in the opposite sense but otherwise is similar to the other elements, the exciting probes which transmit the signals they carry have the same "vertical" separation as the exciting probes of the elements on the front face, which separation is equal to the thickness of the central sheet. Thus, a wide-band antenna output is provided.

A further object of the invention is to provide an antenna output which is located at the centre of the antenna and thus avoid the necessity of providing additional lengths of transmission line, which would be harmful to the efficiency of the antenna.

To this effect, the invention relates to either the antenna output described above for an antenna comprising three sheets and two transmission lines networks, or for a planar antenna comprising an array of receiving elements obtained with the aid of a network of high-frequency transmission lines inserted between a first sheet having first cavities and a second sheet having second cavities which are in-line with the first cavities but are short-circuited in a plane parallel to the surfaces of the sheets. The network is planar and is coupled to each of the cavities by means of a corresponding number of distinct ends forming exciting probes. The sheets are metal-plated or are dielectric sheets with metal-plated cavity walls. This antenna is characterized in that the single end of the transmission line network also constitutes an exciting probe and is coupled to a waveguide directed to the rear of the antenna and constituted by a first cavity in the bottom sheet of the antenna and, in the front sheet, a second cavity which is short-circuited in a plane parallel to the surfaces of the sheets, at a depth equal to that of the short-circuiting plane of the receiving elements.

With such a structure no additional transmission lines are required, but it is also not necessary to provide exterior connectors as the antenna output according to the invention leads directly to the receiving head end or ends of the system.

BRIEF DESCRIPTION OF THE DRAWING

Details and advantages of the invention will be apparent from the following description and the accompanying drawing, figures which are given by way of non limitative example and in which.

DESCRIPTION OF THE PREFERRED EMBODIMENT

Figure 1:
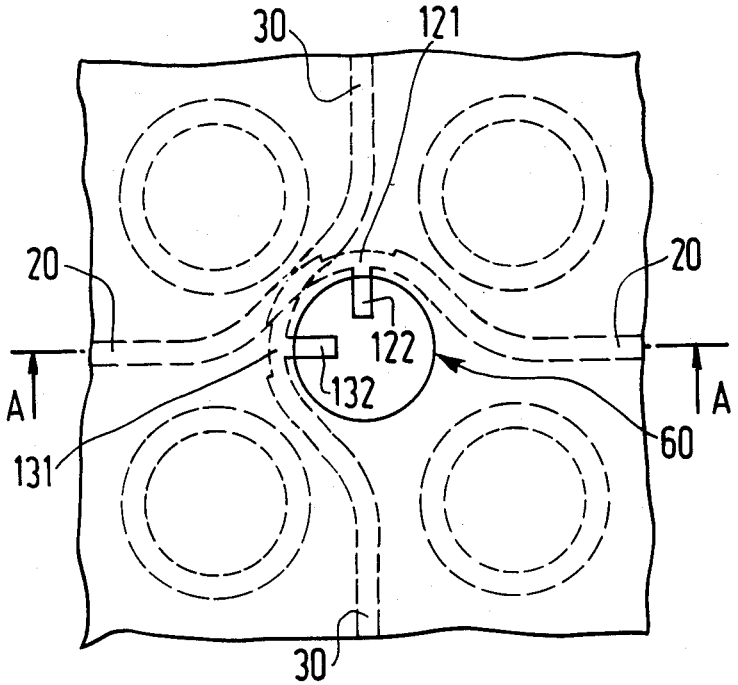
FIG. 1 shows a parallel view of the rear surface of the antenna according to the invention.
Figure 2:
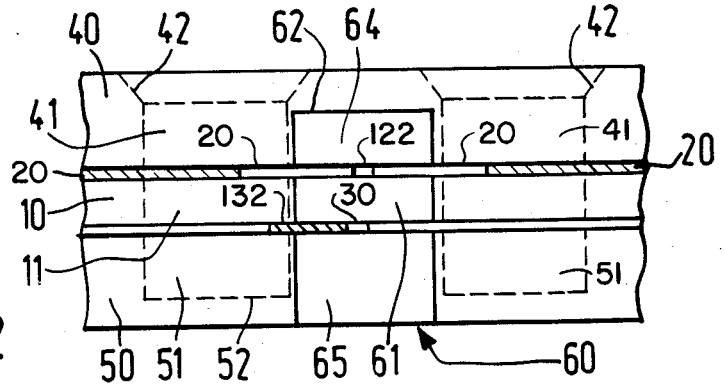
FIG. 2 is a cross-sectional view along the axis AA of FIG. 1.

The high-frequency planar antenna according to the invention comprises, as shown in the Figures, a network of receiving elements obtained in the following way. On both sides of a first layer 10 in which circular cavities 11 are provided arranged to form a matrix, there are positioned the conducting strips of two transmission line networks 20 and 30, which are electrically independent and are each supported by a thin dielectric sheet (not shown) which provides a mechanical support for these networks. A second layer 40 comprising circular cavities 41 and a third layer 50 comprising circular cavities 51 are provided respectively on the other sides of the networks 20 and 30.

These cavities 41 and 51 face the cavities 11. The cavities 51 of the third layer are short-circuited in a plane 52 parallel to the surfaces of the layers 10, 40, 50 at a depth which is less than the thickness of the layer 50, so as to provide a reflecting plane for the high-frequency signals received. The cavities 41 preferably end in a flared portion 42 of conical form 42 which contributes towards increasing the gain. The first, second and third layers 10, 40, 50 are either metal-plated, or made of a dielectric material with metal-plated walls of the cavities 11, 41, 51 penetrating them.

The suspended micro-strip transmission line networks 20 and 30 include probes arranged along two perpendicular axes relative to the cavities of these receiving elements. These probes (not shown here for the sake of simplicity of the Figures) project into each element enabling the reception of the high-frequency signals. The distance which these probes project into the cavities may be different from each other so as to optimize coupling. From these probes, of which there are as many as there are receiving elements, the networks 20 and 30 each proceed via consecutive combining stages to a single end, 121 and 131, respectively, constituting a convergence point obtained in accordance with electric paths of equal lengths. One of these two ends 121 and 131 receives all of the high-frequency signals having respective predetermined linear polarizations, and the other receives all of the high-frequency signals with perpendicular linear polarization.

A sole circular waveguide 60 which is here located in the centre of the rear surface of the antenna is associated with these two ends 121 and 131 in the following way. On the one hand this waveguide 60 occupies a position which is the opposite of the position of the waveguides constituted in the receiving elements by coupling the successive cavities 41, 11, 51, which, to put it more precisely, implicates that this guide 60 which opens towards the rear of the antenna comprises, in succession, a circular cavity 65 in the rear or third layer 50 of the antenna, a circular cavity 61 in the central or first layer 10, and a circular cavity 64 in the front or second layer 40. Only the last-mentioned cavity 64 (as also holds for the rear cavities 51 of the receiving elements of the antenna) is short-circuited in a plane 62 parallel to the surfaces of the layers 10, 40, 50, at a depth which is significantly less than the thickness of the layer 40, this depth being inter alia equal to the depth envisaged for the short circuiting planes 52 in the cavities 51.

Terminal probes 122 and 132 extend from the ends 121 and 131 of the transmission networks 20 and 30 into the waveguide defined by the cavities 65, 61, 64, in the same way in which the probes of the networks 20 and 30 project into respective receiving element openings toward the front of the antenna.

In operation, the networks 20 is the first one to receive the high-frequency signals coming from the propagation means and entering the receiving elements. The forward phase shift produced in this network is compensated by the phase shift into the opposite sense obtained during the transmission in the waveguide 60 of the signals provided at the terminal probes 122 and 132 after they have travelled through the networks 209 and 30.

The high-frequency signals thus received being again accurately in phase, there only remains to place a depolarizing structure (not shown as it is of a known type generally comprising a dielectric sheet arranged longitudinally and diametrically in the guide) in the waveguide 60 and thereafter a mode separator (consequently having two outputs which extend as symmetrically as possible toward two frequency converters) to have again the disposal of orthogonally polarized high-frequency signals transmitted (or retransmitted by geostationary satellites). The mode separator may, for example, be a separator as described in the article "A wideband square-waveguide array polarizer" published in IEEE Transactions on Antennas and Propagation, May 1973, pages 389 to 391 (see more specifically FIG. 1 of this article). The two frequency converters, or receiving front ends, may be (when they receive 12 GHz television signals transmitted via satellites) more specifically of the front end type described in the periodical "L'Onde Electrique", Vol. 62, No. 3, March 1982, pages 39 and 40.

It will be obvious that the present invention is not limited to the above-described embodiments, on the basis of which other variations may be proposed without departing from the scope of the invention. More specifically, the antenna output proposed is advantageous even for an antenna intended to receive signals of one single type of polarization only and which to this effect comprises only one single network of transmission lines inserted between two sheets; actually even in this case, the structure proposed is a very economical structure for the above-specified reasons, compared with the present solutions in which additional transmission lines and exterior connectors are used. Furthermore, the invention covers any system for receiving high-frequency signals comprising a planar antenna as described above, the choice adopted here by way of example of 12 GHz television signals not being limitative neither for the operating frequency nor for the nature of this system (it may be incorporated in ground-based transmission networks as well as in satellite transmission networks).

What is claimed is:

1. An antenna system including a planar antenna having an array of radiating elements coupled to a waveguide, said antenna system comprising:

(a) a first layer including a plurality of radiating-element-defining cavities and a waveguide-defining cavity, said cavities having conductive inner surfaces;

(b) a second layer disposed on one side of the first layer and including a plurality of radiating-element-defining cavities and a waveguide-defining cavity aligned with corresponding ones of the cavities in the first layer, said cavities in the second layer having conductive inner surfaces, said waveguide-defining cavity extending into the second layer from a side facing the first layer to a predetermined depth, which is smaller than the second layer thickness, and ending at a short-circuit termination formed by a portion of the conductive inner surface of said cavity which is substantially parallel to said one side of the first layer;

(c) a third layer disposed on an opposite side of the first layer and including a plurality of radiating-element-defining cavities and a waveguide-defining cavity aligned with corresponding ones of the cavities in the first layer, said cavities in the third layer having conductive inner surfaces, said radiating-element-defining cavities each extending into the third layer from a side facing the first layer to said predetermined depth, which is also smaller than the third layer thickness, and ending at a short-circuit termination formed by a portion of the conductive inner surface of said cavity which is substantially parallel to said opposite side of the first layer;

(d) a first conductive strip, disposed between the first and second layers, forming a first transmission line network having portions forming respective exciting probes which extend into the waveguide and the radiating elements in a first direction, said network effecting coupling of the radiating elements to the waveguide for radiated energy of a first polarity; and (e) a second conductive strip, disposed between the first and second layers, forming a second transmission line network having portions forming respective exciting probes which extend into the waveguide and the radiating elements in a second direction orthogonal to the first direction, said network effecting coupling of the radiating elements to the waveguide for radiated energy of a second polarity orthogonal to the first polarity.

2. An antenna system including a planar antenna having an array of radiating elements coupled to a waveguide, said antenna system comprising:

(a) a first layer including a plurality of radiating-element-defining cavities and a waveguide-defining cavity, said cavities having conductive inner surfaces, said waveguide-defining cavity extending into the first layer from one side thereof to a predetermined depth, which is smaller than the first layer thickness, and ending at a short-circuit termination formed by a portion of the conductive inner surface of said cavity which is substantially parallel to said one side of the first layer;

(b) a second layer having one side thereof disposed opposite said one side of the first layer, said second layer including a plurality of radiating-element-defining cavities and a waveguide-defining cavity aligned with corresponding ones of the cavities in the first layer, said cavities in the second layer having conductive inner surfaces, said radiating-element-defining cavities each extending into the second layer from one side thereof to said predetermined depth, which is also smaller than the second layer thickness, and ending at a short-circuit termination formed by a portion of the conductive inner surface of said cavity which is substantially parallel to said one side of the second layer; and (c) a conductive strip, disposed between the first and second layers, forming a transmission line network including portions forming respective exciting probes which extend into the waveguide and the radiating elements, said network effecting coupling of the radiating elements to the waveguide.

* * * * *